US009498073B2

(12) United States Patent
Argyle

(10) Patent No.: US 9,498,073 B2
(45) Date of Patent: Nov. 22, 2016

(54) CORNER PICTURE HANGER

(76) Inventor: Micah Monroe Argyle, Idaho Falls, ID (US)

( * ) Notice: Subject to any disclaimer, the term of this patent is extended or adjusted under 35 U.S.C. 154(b) by 639 days.

(21) Appl. No.: 12/905,548

(22) Filed: Oct. 15, 2010

(65) Prior Publication Data

US 2011/0186707 A1 Aug. 4, 2011

Related U.S. Application Data

(60) Provisional application No. 61/299,539, filed on Jan. 29, 2010.

(51) Int. Cl.
*A47G 1/16* (2006.01)

(52) U.S. Cl.
CPC ..... *A47G 1/16* (2013.01)

(58) Field of Classification Search
CPC ..... A47G 1/16; A47G 1/1653; A47G 1/24; Y10T 16/551; Y10T 16/5513; Y10T 24/1397
USPC ..... 248/489, 492, 493, 495, 481, 327, 328, 248/329, 220.1, 320, 322, 685; 242/378.3, 242/384.7, 378, 378.1, 378.2; 40/646
See application file for complete search history.

(56) References Cited

U.S. PATENT DOCUMENTS

| | | | | | |
|---|---|---|---|---|---|
| 84,266 | A | * | 11/1868 | Davies | 248/489 |
| 164,937 | A | * | 6/1875 | Robertson | 248/492 |
| 505,230 | A | | 9/1893 | Robinson | |
| 549,505 | A | * | 11/1895 | Eldridge | 248/489 |
| 603,146 | A | * | 4/1898 | Lord | 248/492 |
| 613,841 | A | * | 11/1898 | Lord | 248/492 |
| 703,709 | A | * | 7/1902 | Olmstead | 16/198 |
| 769,695 | A | * | 9/1904 | Gurr | 248/492 |
| 885,172 | A | * | 4/1908 | Patrick | 242/377 |
| 1,057,484 | A | * | 4/1913 | Huber | 24/135 N |
| 1,153,829 | A | * | 9/1915 | Rueckert | B60R 22/34 191/12.2 R |
| 1,219,025 | A | | 3/1917 | Mertz | |
| 1,959,745 | A | * | 5/1934 | Stout | 248/489 |
| 4,049,225 | A | * | 9/1977 | Chasen et al. | 248/219.4 |
| 4,364,538 | A | * | 12/1982 | Tomlinson | 248/495 |
| 4,392,316 | A | * | 7/1983 | Thomas | 40/617 |
| 4,555,082 | A | * | 11/1985 | Sack et al. | 248/220.1 |
| 4,556,184 | A | * | 12/1985 | O'Sullivan | 248/330.1 |
| 4,601,453 | A | * | 7/1986 | Kagan | 248/329 |
| 5,042,766 | A | * | 8/1991 | Baker | 248/200.1 |
| 5,094,396 | A | * | 3/1992 | Burke | B65H 75/44 242/375 |
| 5,094,421 | A | | 3/1992 | Zaccone | |
| 5,154,384 | A | | 10/1992 | Owens | |
| 5,269,487 | A | * | 12/1993 | Heitzman | 248/489 |
| 5,810,317 | A | | 9/1998 | Macchi | |
| 6,152,410 | A | * | 11/2000 | Mark | 248/220.1 |

(Continued)

OTHER PUBLICATIONS

Website for Corner Crab: www.cornercrab.com/installation_tips.php_website no longer functional and unable to pull the site from internet archives.

*Primary Examiner* — Terrell McKinnon
*Assistant Examiner* — Michael McDuffie
(74) *Attorney, Agent, or Firm* — Robert L. Shaver; Shaver & Swanson, LLP

(57) ABSTRACT

Presented is a device for hanging a picture frame in the corner of a room, with a wall attachment bracket, and a tensioning device for pressing the picture frame into contact with the walls of the corner. The tensioning device can be an elastic tubing, a retracting reel, or a cord with a tightening device.

14 Claims, 3 Drawing Sheets

(56) References Cited

U.S. PATENT DOCUMENTS 6,364,261 B1 4/2002 Vass, Jr.
6,634,610 B1 * 10/2003 Ricci ..... G09F 7/18 242/378
6,874,264 B1 * 4/2005 Coito ..... 40/757
2004/0026593 A1 * 2/2004 Fay ..... 248/489
2005/0001136 A1 * 1/2005 Fleishman ..... 248/489
2008/0023615 A1 * 1/2008 Scarcello ..... 248/480

* cited by examiner

CORNER PICTURE HANGER

PRIORITY/CROSS-REFERENCE TO RELATED APPLICATIONS

This application claims the benefit of U.S. Provisional Application No. 61/299,539, filed Jan. 29, 2010, the disclosure of which is incorporated by reference.

TECHNICAL FIELD

The presently disclosed and claimed inventive device generally relates to a device for hanging pictures, and more particularly to a device and apparatus for hanging pictures in the corner of a room.

BACKGROUND

Hanging pictures frames, often containing art, documents, items in shadow boxes, framed posters, and any use of framed wall decorations is an essential part of decorating a room and home, but there are no functional devices to facilitate use of a corner for hanging a picture frame. An area that could be useful for placement of certain framed art is the corner of a room. Several devices are described in patents for hanging items in the inside corner of a room. Some of these devices are specifically for things such as stuffed animal heads, and others are for picture frames or other corner mounted objects. None of the prior art devices are very handy, and may be difficult to use or expensive to make. The present device is simple to use, and easy to mount, and very practical for holding a picture frame or similar structure in a corner of a room.

SUMMARY OF THE DISCLOSURE

The invention is a device for hanging a picture frame or similar structure in the corner of a room. This device takes the form of an assembly that together enables a person to hang a framed picture in any corner of a room. The picture hanging assembly includes a wall attachment bracket for attachment to walls where two walls of the room meet, either directly in the corner or near the corner. The wall attachment bracket can take a number of forms, ranging from something like a simple eye screw or hook to a more substantial bracket, depending upon the installation. One type of wall attachment bracket is similar to a hinge, and has left and right plates at approximately 90 degrees to each other for fitting into the corner of a room and attaching to the studs inside a wall. Such an angled device could be fixed or hinged, so that the plates can move in relation to each other and shaped to fit into the corner of a wall. Another version of the wall attachment bracket can be a plate which is attached near the corner, on one of the walls of the corner, with a hook or loop on the plate for use in attaching the picture frame. Another version of a wall attachment bracket is a hinge-like attachment bracket attached to one edge of the picture frame, which would allow the picture frame to hinge away from one wall, while being attached to the other wall.

Another part of the assembly is a picture frame attachment bracket which attaches to two opposite sides of a picture frame, which can be the left and right side or the top and bottom side. Typically, the picture frame attachment bracket would have two attachment brackets which fit on the left and right or top and bottom side of the picture frame. To these would be attached a hanging loop connecting the two brackets. The cable connecting the two brackets would be utilized to pull the picture frame towards the wall attachment bracket.

The third component of the assembly is the tensioning unit which would typically be a reel from which extends a connector cord, with the connector cord made of a material such as a woven wire cable or metallic wire, or a cord made of any number of materials such as nylon, cotton, and Dacron®, etc. It may also be a material such as a flat strip, which may be made of Mylar®, carbon fibers, other synthetic material, or metal. The reel would include a spool which retracts the connector into the reel. The reel would typically be attached on one side to the wall attachment bracket in the corner, and would be attached on the other side to the picture frame attachment bracket. One or both sides of the connector extending from the reel would be withdrawn into the reel and would provide sufficient tension on the connector to pull the picture frame into the corner in contact with the walls, and secure the picture frame by friction against the two walls.

The reel on the connector could be driven by a spring and would thus be allowed to retract the connector by spring power to hold the picture frame in place. The reel can also be manually wound, such as with a ratcheting spool which is manually turned, so that the user may apply the force necessary for a particular frame to be held against the walls in the corner. The manual reel would have a release in order remove the picture frame from its mounted position. In either of these configurations, the assembly of the device results in a self leveling installation of a picture frame. As the frame is drawn toward the corner of the room, the connector cord pulls it into a level and straight position against the walls.

In one embodiment of the picture hanging assembly, a ball joint is part of the wall attachment bracket, and the tensioning unit attaches either to a loop on the ball joint or to a section of connector material which is attached to the ball joint. The wall attachment bracket, which has a left and a right side plate, may be fixedly formed in a 90 degree angle, or the two side plates may be hinged to each other as in a door hinge.

In one version of the device, the tensioning means is a section of elastic tubing. The elastic tubing would be sized for different sizes of picture frames, in terms of diameter, and length. The elastic tubing could be used with one or more connecting cords, to connect the wall attachment unit or bracket to the picture frame, via the hanging loop or picture frame.

In another embodiment of the device the tensioning means is a cord attached at one end to the wall attachment unit or bracket, and at the other end to the hanging loop or picture frame. The cord could be manually tightened, by use of a knot which holds tension, such as a prussick, taughtline hitch, or truckers hitch. The cord could also be manually tightened by a clip such as are used to tighten and secure tent guy lines.

Another embodiment of the invention includes a hinge-like wall mount, attached to the side of a picture frame. This would allow the picture frame to swing out and away from the corner where the walls meet.

DEFINITIONS

Figure 1:
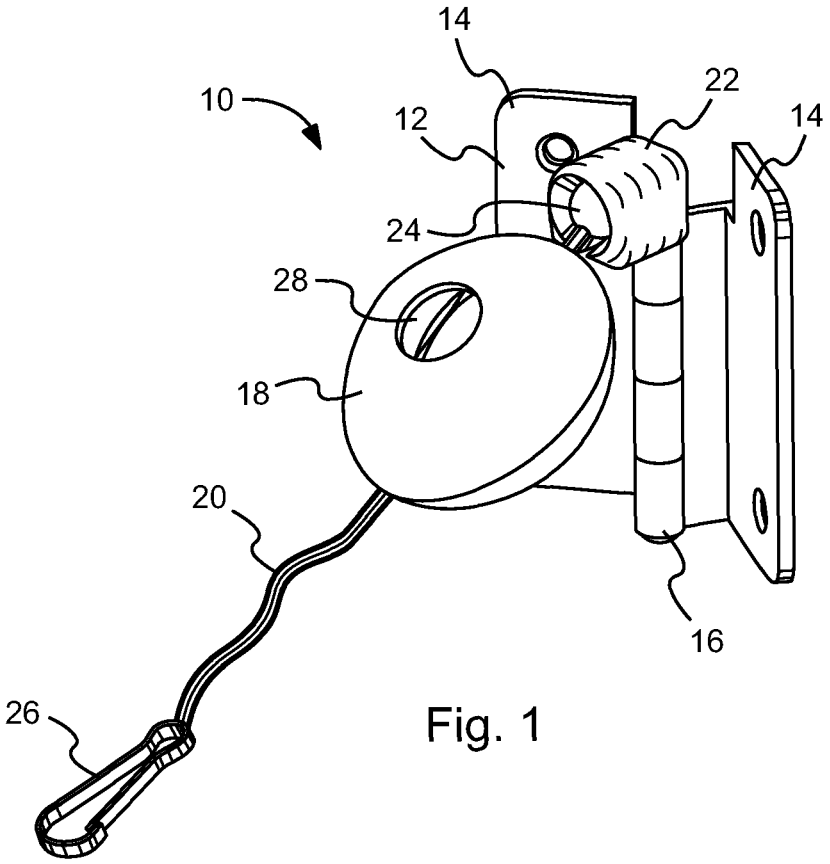
FIG. 1 is a perspective view of a version of the corner mounted picture hanger.

In the following description and in the figures, like elements are identified with like reference numerals.

The use of "e.g.," "etc," and "or" indicates non-exclusive alternatives without limitation unless otherwise noted.

The use of "including" means "including, but not limited to," unless otherwise noted.

Detailed Description Of An Exemplary Embodiments

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

Shown in FIGS. 1 through 4 are several versions of preferred embodiments. The requirements of the patent office are that at least one preferred embodiment be shown, and although several different preferred embodiments are illustrated here, these are not meant to limit the scope of the invention, but are mainly illustrative of at least one preferred embodiment. The scope of the definition is to be defined by the claims, not the figures, and not the description of the preferred embodiments, nor by omission of a preferred embodiment.

While certain exemplary embodiments are shown in FIGS. 1 through 4 and in this disclosure, it is to be distinctly understood that the presently disclosed inventive concept(s) is not limited thereto but may be variously embodied to practice within the scope of the claims that follow. From the description, it will be apparent that various changes may be made without departing from the spirit and scope of the disclosure as defined by the claims.

FIG. 1 shows one preferred embodiment of the invention, with the corner picture bracket of the invention identified with the numeral 10. This embodiment includes a wall attachment bracket 12, which in this case is hinge-like and has two hinge sides 14 or hinge leaves which are connected to each other by a hinge pin. The bracket could be movable or a solid 90 degree angle bracket. The attachment bracket can also be a flat plate with a hook or loop for attachment of the cord 20. Such a flat plate would be attached to only one of the walls near the corner.

This version of the device also has a retracting reel 18 on which is stored a flexible cord 20. The reel 18 is attached to the wall attachment bracket 12, in this case by a ball 20 which fits in a socket 22. Attached to the end of the cord 20 is an attachment clip 26.

The cord 20 would typically be made of a flexible material such as a monofilament or woven or braided material, made of metal, plastic, or a synthetic or natural material typically used for picture hanging.

The reel 18 could take a number of forms and there are a number of take-up reels which retract and extend cord-like material, including reels which store wires for telephones, metal cables, woven cords, and other devices. Any of these devices which retract a cord with sufficient force to hold a picture frame in place against the two walls of a corner would be an adequate reel.

Figure 3:
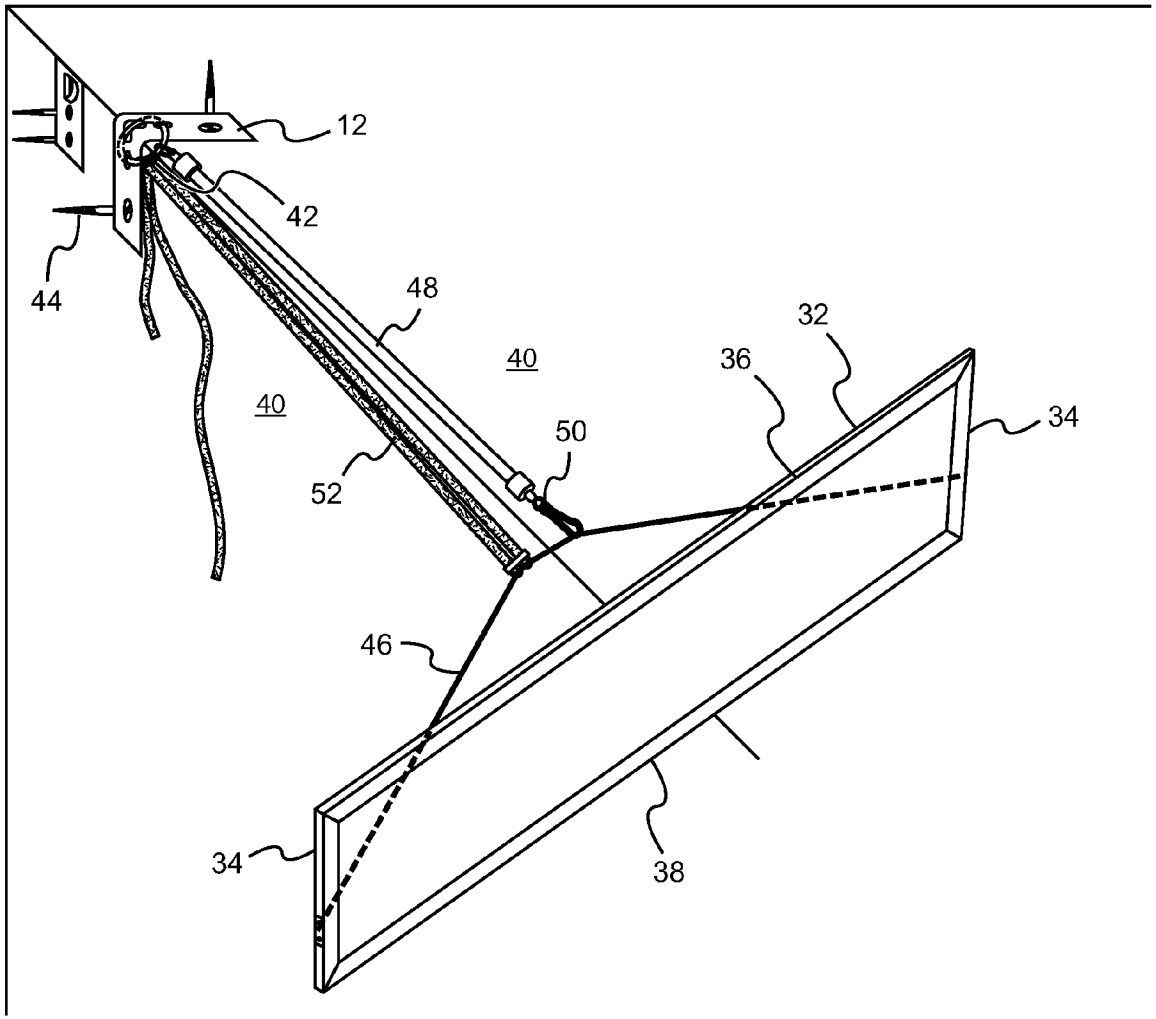
FIG. 3 is a perspective view of a different embodiment of the corner mounted picture hanger.

Picture frames are normally hung from the wall by a string which is attached to the two lateral sides of the frame. In the normal installation, the cord which runs between the two lateral sides of a picture frame is hung over a nail, a hook, or another device which is attached to the flat wall. The corner picture bracket of FIG. 1 attaches to a cord attached to the side wall of the frames in a similar manner. In use, the corner picture bracket 10 would be mounted in the corner of a wall at the approximate height where a picture frame is desired to be placed. The corner picture bracket would be selected according to the size and weight of the frame to be hung, and larger brackets with more powerful reels may be required for larger picture frames. With the corner picture bracket mounted, the attachment clip 26 would be extended until it was sufficiently extended to attach to two lateral sides of a picture frame at the first and second frame attachment units attached typically to the left and right sides of the frame. Attachment to the top and bottom sides of the frame is also an option. FIG. 3 shows the hanging loop 46 attached to a frame attachment unit. The reel 18 could be configured to retract the cord 20 into the reel 18 as soon as it is released. In that case, reel 18 would draw the picture frame towards the corner of the room, guided by the user until the frame contacted the wall. When the two sides of the picture frame contacted the walls near the corner, the retracting reel 18 would pull the cord 20 sufficiently tight to hold the picture frame against the two walls adjacent the corner of the room by friction. The reel could be released by pressing a release button 28 on the top of the reel 18.

Although the hinged sides 14 are shown as being foldable, as is the hinge on a door, these could also be a solid bracket with the mounting plates placed at a 90° angle to each other.

Figure 2:
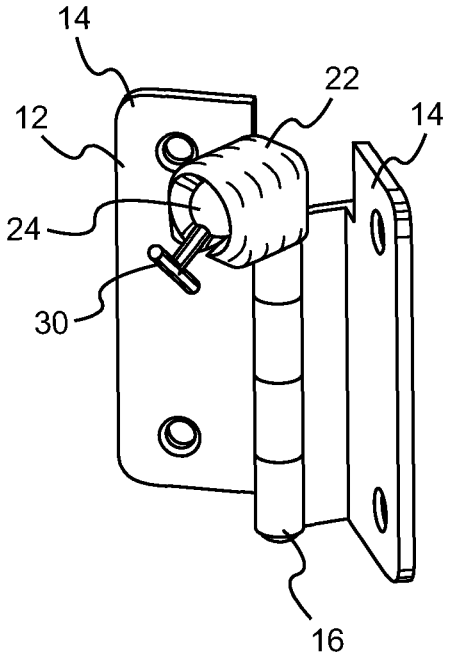
FIG. 2 is a perspective view of part of the corner mounted picture hanger.

FIG. 2 shows another view of the same embodiment, with the hinge sides 14, a socket 22, and the ball 24, more visible. Attached to the ball is a linkage 30 which attaches to the reel 18 and holds it in place. FIGS. 1 and 2 show the reel 18 attached directly to the ball 24, but it could also operate that the reel 18 is attached to the wire hanging cord of the frame, and the attachment clip 26, or something similar to it, could be attached to the wall attachment bracket 12. Similarly, as in FIG. 1, the two hinge sides 14 could be fused together to form a 90° bracket which fits in the corner between the two walls.

FIG. 3 shows another preferred embodiment of the invention. FIG. 3 shows a picture frame 32 with a left and right lateral side 34 and a top side 36 and bottom side 38. Shown is a wall attachment bracket 12 which attaches to the walls 40 in the corner of a room. It includes a hook or loop 42. Once the wall attachment bracket is securely attached to the wall, in this case by screws 44, it would be attached to the hanging loop 46, which is attached to the picture frame 32. The attachment between the hook or loop 42 and the hanging loop 46 can be by various means; one is by an elastic material exemplified by a length of rubber tubing 48. The tubing can be the consistency of surgical tubing, and can be of various lengths and thicknesses to support different weights of picture frames. The tubing 48 can have a clip or hook 50 which links it with the hanging loop 46 of the picture frame, or use an attachment clip 26 as shown. The other end of the tubing 48 will typically attach to the hook or loop 42 by any number of conventional attachment means, such as a loop as shown, or by a hook, or by doubling the tubing over the hook 42 and attaching both ends of the tubing to the hanging loop.

The picture frame 32 and the hanging loop 46 can also be attached to the wall attachment bracket 12 by any of a number of configurations using a cord 52, as shown in FIG. 3. The cord 52 can be a double strand as shown in the figure, or can be a single strand with a hook which attaches to the hanging loop. The cord 52 can be adjusted and tightened by a number of means and can optionally include a section of tubing 48 in order to provide additional resiliency to the attachment.

As an example of devices for adjusting and tightening the cord 52, there are a large number of tent line adjusting clips which are used to adjust the tension on lines holding down a tent for camping. Examples of these adjusters include Microlok®, Lineloc®, Liberty Mountain guyline adjusters, MSR® cord tensioner, and FIG. 9 rope tighteners. Each of these adjusters is configured to work with a cord and allow the cord to be tightened and loosened as the user prefers. In use, the tubing 48, the cord 52, a cord tensioner of some type would be used to provide tension between the wall attachment bracket 12 and the picture frame 32. Tension from the cord 52 or the tubing 48 would hold the picture frame 32 in place with the lateral sides of the picture frame 34 pressed firmly against the walls 40. In addition to the cord, and the tubing, other materials or combinations of materials could be used to provide sufficient tension to hold the picture frame in place against the walls. This could include cord combined with tubing, chain, and chain combined with tubing, springs, or other tensioners, or any other equivalent attachment structure.

Figure 4:
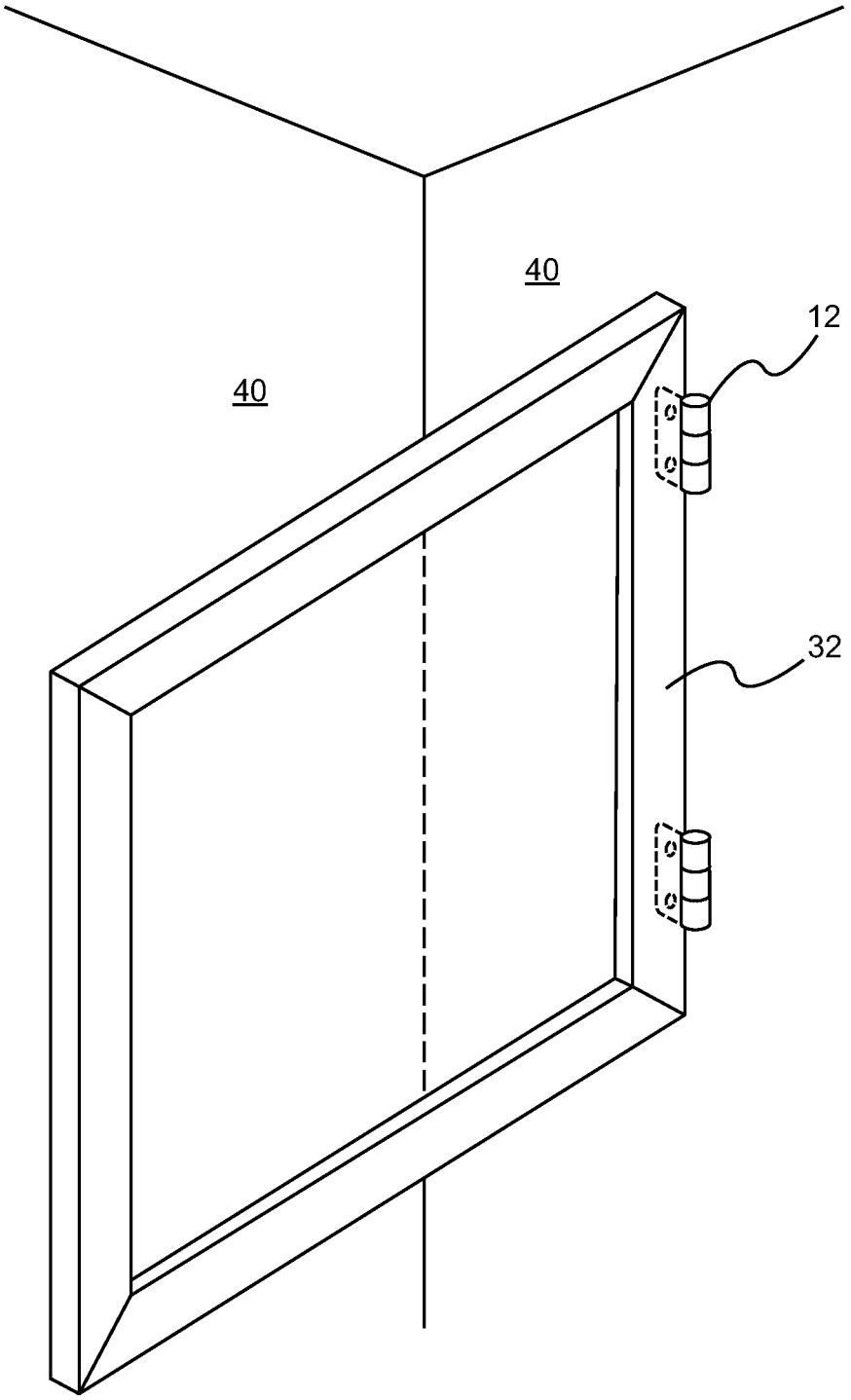
FIG. 4 is a perspective view of a different embodiment of the corner mounted picture hanger.

Shown in FIG. 4 is another preferred embodiment of the invention, which includes a wall attachment bracket 12 attached to a picture frame 32. The wall mount bracket 12, in this case, is attached to either of the walls 40 and acts in a hinge like manner to allow the frame to move away from and towards the wall to which it is not attached directly. Although door type hinges are shown, other hinge type brackets can also be utilized, such as a piano hinge, a spring return hinge, or other hinge like devices.

What is claimed is:

1. A picture hanging assembly, comprising:

a wall attachment bracket consisting of attached left and right plates, each plate for attaching to a wall adjacent to a corner where two walls meet;

a picture frame attachment unit with a first frame attachment unit and a second attachment unit, configured to attach to a first and second side of a picture frame, with a connecting cord attached to said first and said second attachment units; and a tensioning unit, for connecting said connecting cord and said wall attachment; wherein tension from said tensioning unit pulls said picture into engagement with said walls for positioning said picture in said corner, wherein said tensioning unit is comprised of a reel for extending and retracting a connector on at least one side, and an attachment loop on a second side, with said attachment loop for attachment to either said wall attachment bracket or said connecting cord, with said reel configured to pull said connecting cord into said reel, thus pulling said picture frame toward said wall attachment bracket in a corner of a room.

2. The picture hanging assembly of claim 1 in which said tensioning unit is comprised of a cord with a cord tensioning device, with said cord attached to said wall attachment bracket, with said cord and said cord tensioning device configured to apply sufficient tension to said connecting cord to hold said picture frame in position against said walls.

3. The picture hanging assembly of claim 1 in which said wall attachment bracket has two plates capable of forming a 90 degree angle bracket.

4. The picture hanging assembly of claim 3, in which said wall attachment bracket is hinged with the two plates movable from each other, and joined by a hinge pin.

5. The picture hanging assembly of claim 1 in which said picture frame unit attaches to right and left sides of a picture frame.

6. The picture hanging assembly of claim 1 in which said picture frame unit attaches to top and bottom sides of a picture frame.

7. The picture hanging assembly of claim 1 in which said tensioning unit is fixedly attached to said wall attachment bracket, and retractably attached to said picture frame attachment unit.

8. The picture hanging assembly of claim 1 in which said tensioning unit is fixedly attached to said picture frame attachment unit, and retractably attached to said wall attachment bracket.

9. The picture hanging assembly of claim 1 in which said connector of said tensioning unit is a flexible wire.

10. The picture hanging assembly of claim 1 in which said connector of said tensioning unit is a flexible cord.

11. The picture hanging assembly of claim 1 which further comprises a ball joint attached to said wall attachment bracket.

12. The picture hanging assembly of claim 1 in which said bracket comprises a left and right side plate at approximately a 90 degree angle to each other for placement on different walls in a corner.

13. The picture hanging assembly of claim 1 in which said reel extends and retracts from each of its sides.

14. A picture hanging assembly, comprising: a wall attachment bracket with hingedly attached left and right plates, each plate for attaching to a wall adjacent to a corner where two walls meet; a picture frame attachment unit with a first frame attachment unit and a second attachment unit, configured to attach to a first and second side of a picture frame, with a connecting cord attached to said first and said second attachment units; and a tensioning unit, for connecting said connecting cord and said wall attachment bracket; wherein said tensioning unit pulls said cord, allowing picture into engagement of said picture with said walls for positioning said picture in said corner.

* * * * *